US008677518B2

(12) United States Patent
Spievey et al.

(10) Patent No.: US 8,677,518 B2
(45) Date of Patent: Mar. 25, 2014

(54) PORTABLE TOILET SEAT

(76) Inventors: Sheila L. Spievey, Middletown, CT (US); Michael L. Spievey, Middletown, CT (US)

( * ) Notice: Subject to any disclaimer, the term of this patent is extended or adjusted under 35 U.S.C. 154(b) by 842 days.

(21) Appl. No.: 12/662,963

(22) Filed: May 13, 2010

(65) Prior Publication Data

US 2011/0099699 A1 May 5, 2011

Related U.S. Application Data

(60) Provisional application No. 61/272,777, filed on Nov. 2, 2009.

(51) Int. Cl.
*A47K 13/14* (2006.01)

(52) U.S. Cl.
USPC ..... 4/245.6; 4/245.7; 4/245.8; 4/245.1

(58) Field of Classification Search
USPC ..... 4/245.1, 245.3–245.8; 297/219.1
See application file for complete search history.

(56) References Cited

U.S. PATENT DOCUMENTS

| | | | | |
|---|---|---|---|---|
| 538,795 | A * | 5/1895 | Saponoff | 4/245.3 |
| 682,871 | A * | 9/1901 | Hogan | 5/644 |
| 1,221,661 | A * | 4/1917 | Bloch | 4/245.8 |
| 1,268,024 | A | 5/1918 | Levin | |
| 1,530,424 | A * | 3/1925 | Lydia Shollar | 4/245.6 |
| 1,592,597 | A | 7/1926 | Becker | |
| 1,643,413 | A | 9/1927 | Mahoney | |
| 1,682,799 | A | 9/1928 | Richards | |
| 1,835,787 | A | 12/1931 | Kniseley | |
| 2,443,068 | A | 6/1948 | Dahle | |
| 2,481,427 | A * | 9/1949 | Hunter | 4/456 |
| 2,742,650 | A | 4/1956 | Mohun | |
| 3,331,085 | A * | 7/1967 | Potosky | 4/245.7 |
| 3,671,981 | A * | 6/1972 | Smith | 4/245.7 |
| 4,525,880 | A | 7/1985 | Bass | |

(Continued)

FOREIGN PATENT DOCUMENTS

| | | |
|---|---|---|
| DE | 4223104 | 1/1993 |
| DE | 4218332 | 12/1993 |
| WO | WO-03/065865 | 8/2003 |

OTHER PUBLICATIONS

Website, http://www.safetycentral.com/toilseatcov.html, "Charmin To Go" toilet seat cover packs, two sheets printed from the internet on Nov. 8, 2008.

*Primary Examiner* — Huyen Le
*Assistant Examiner* — Erin Deery
(74) *Attorney, Agent, or Firm* — Richard C. Litman

(57) ABSTRACT

The reusable, portable toilet seat has a planform congruent with a conventional toilet seat and includes a base of corrugated sheet material with a sheet of air-filled plastic wrap thereover and a layer of non-woven batting overlying the air-filled material. The core materials are covered on their upper and lower surfaces with thin plies of flexible, liquid impervious plastic. The cover sheets are heat sealed to one another along their inner and outer edges to prevent contamination and deterioration of the internal structure. At least one ply of cover material extends outwardly beyond the outer periphery of the core materials to drape over the toilet seat and rim of the bowl when the portable seat is secured to an existing toilet seat by suction cups extending from the base material. The portable toilet seat is washable for convenience, and may be folded for compact storage within a provided storage bag.

8 Claims, 4 Drawing Sheets

(56) References Cited

U.S. PATENT DOCUMENTS

| | | | | | |
|---|---|---|---|---|---|
| 4,698,864 | A | * | 10/1987 | Graebe | 5/654 |
| 4,806,406 | A | | 2/1989 | Akerman et al. | |
| 4,998,297 | A | | 3/1991 | Summerville | |
| 5,005,223 | A | | 4/1991 | Greenwood | |
| 5,090,063 | A | | 2/1992 | Edwards et al. | |
| D333,701 | S | | 3/1993 | Meeks | |
| 5,274,846 | A | * | 1/1994 | Kolsky | 2/460 |
| 5,619,757 | A | | 4/1997 | Baratta | |
| 5,790,989 | A | | 8/1998 | Chen | |
| 5,845,352 | A | * | 12/1998 | Matsler et al. | 5/654 |
| 5,996,133 | A | * | 12/1999 | Fletcher | 4/239 |
| 6,370,704 | B1 | * | 4/2002 | White, Jr. | 4/237 |
| D502,538 | S | | 3/2005 | Soria-Ibarra et al. | |
| D502,766 | S | | 3/2005 | Nash | |
| D530,804 | S | | 10/2006 | Forbes et al. | |
| 2006/0168715 | A1 | | 8/2006 | Brown | |
| 2007/0124854 | A1 | * | 6/2007 | Spratt et al. | 4/245.6 |
| 2009/0013455 | A1 | | 1/2009 | Richardson | |

* cited by examiner

PORTABLE TOILET SEAT

CROSS-REFERENCE TO RELATED APPLICATION

This application claims the benefit of U.S. Provisional Patent Application Ser. No. 61/272,777, filed Nov. 2, 2009.

BACKGROUND OF THE INVENTION

1. Field of the Invention

The present invention relates generally to sanitation and personal hygiene, and particularly to a reusable, portable toilet seat capable of being folded for compact storage and carriage for use in public restrooms and the like for removable placement atop an existing seat.

2. Description of the Related Art

The need for restrooms accessible by the general public has been widely recognized. Accordingly, public restrooms are nearly universally found in automobile service stations, restaurants, sports stadiums and facilities, public transportation facilities, and numerous other facilities usable and accessible by the public. While most persons responsible for such restroom facilities attempt to maintain the restrooms in a clean and hygienic state, this is unfortunately not always the case. In some instances the responsible staff may not have time to clean the restrooms as they should be cleaned, or may just avoid such duties. In other cases the slovenliness of a large group or the public in general can render an otherwise clean restroom into an unsanitary mess in short order.

Accordingly, it is common practice to provide disposable toilet seat covers in restrooms for use by those who wish to avoid direct contact with the toilet seat. However, not all restrooms are equipped with such covers, and in many cases the supply of covers is not replenished as soon as it is depleted. In any event, oftentimes such covers do not provide the protection desired if the toilet seat is wet, as such disposable covers are formed of a thin, lightweight tissue that is moisture absorbent.

Thus, a portable toilet seat solving the aforementioned problems is desired.

SUMMARY OF THE INVENTION

The portable toilet seat is a foldable and reusable supplemental seat for removable placement upon an existing toilet seat. The device is formed to have a substantially congruent planform to a conventional toilet seat, with a plurality of suction cups extending from the bottom surface to provide for removable attachment to the existing seat. The device further includes a series of preformed folds or creases to facilitate folding the device for compact storage. A storage bag may be included with the device for further convenience.

The device comprises a relatively firm and rigid base or substrate of corrugated material (cardboard, plastic, etc.) with a sheet or layer of air-filled plastic wrap (e.g., Bubble Wrap®) thereabove. A layer of non-woven fiber batting, e.g., polyester, etc., is applied atop the air-filled plastic wrap, and the assembly is enclosed in a thin, flexible plastic cover sheet over its upper and lower surfaces. The upper and lower plies of the cover sheet are heat sealed to one another along their inner and outer peripheries in order to preclude the entry of contamination between the plies, and preferably include at least one ply that extends beyond the outer periphery of the corrugated sheet and padding layers to overlie the edges of the toilet seat and bowl. In this manner, a user of the device need not contact or grip the edge of the seat or bowl directly.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
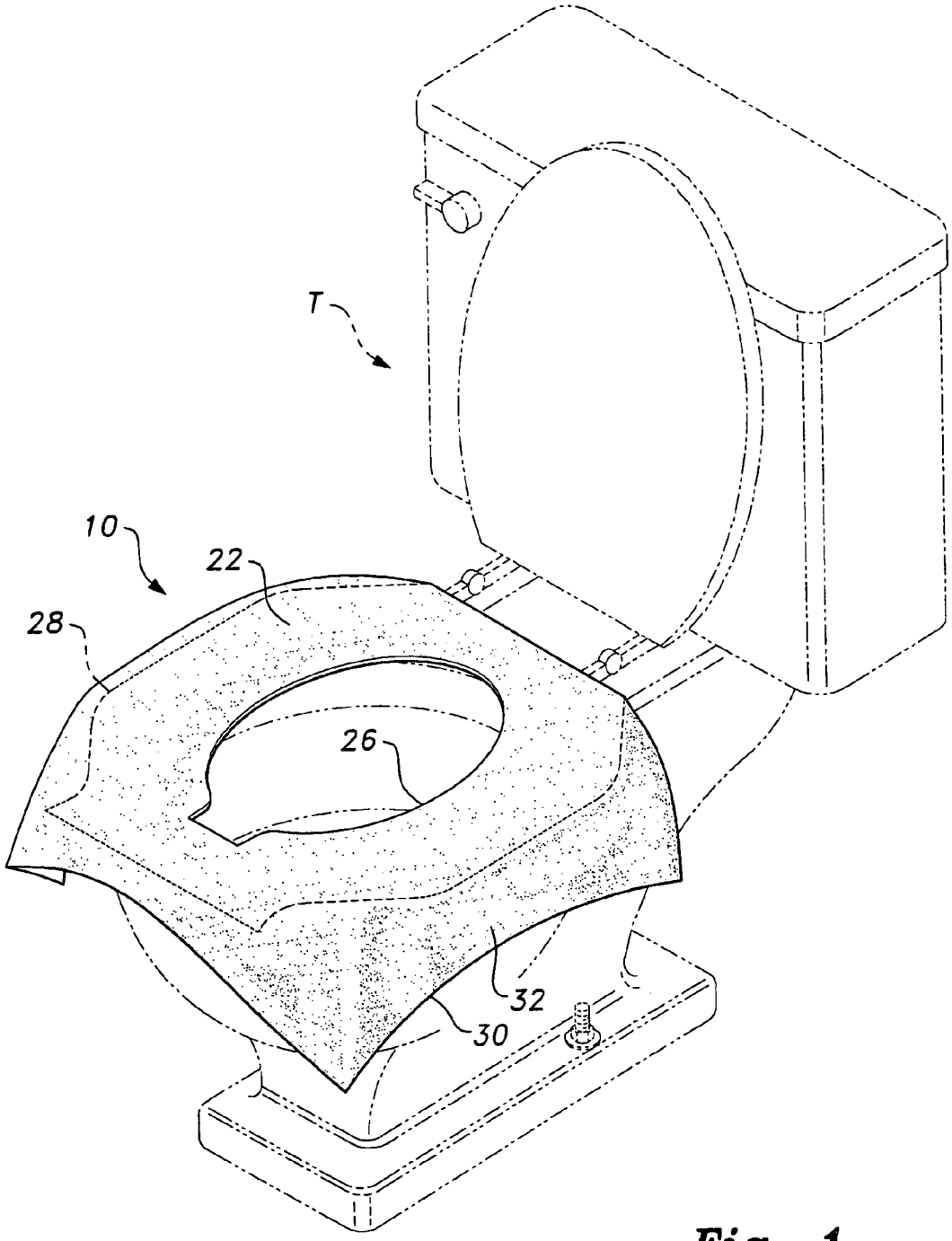
FIG. 1 is an environmental, perspective view of a portable toilet seat according to the present invention, illustrating its placement upon a toilet seat.

The portable toilet seat is a washable and reusable toilet seat for use in public restrooms and the like where sanitation may be questionable at best. The portable toilet seat may be folded for compact storage, and may be conveniently stored and carried in a small bag or container. FIG. 1 of the drawings is an illustration of the portable toilet seat 10 deployed over the conventional toilet seat (not shown) of a toilet T.

Figure 2:
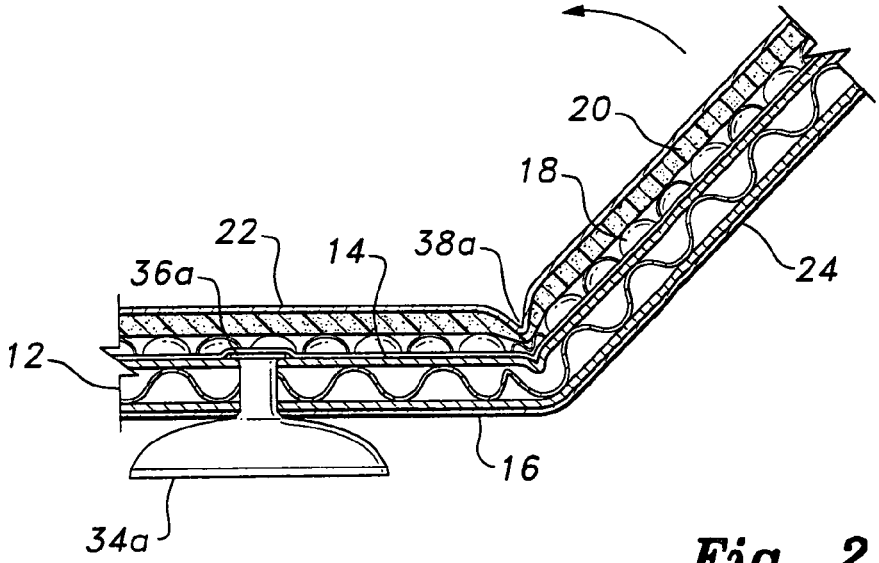
FIG. 2 is a detailed, fragmented elevation view in section of a portion of the portable toilet seat, showing a fold parallel to the corrugations of the base material.
Figure 3:
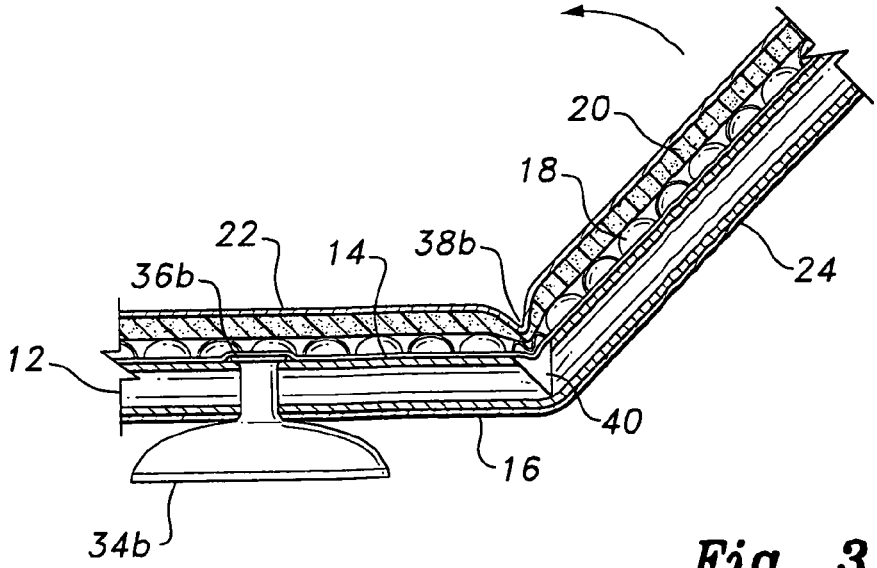
FIG. 3 is a detailed, fragmented elevation view in section of a portion of the portable toilet seat, showing a fold across the corrugations of the base material and a score across the corrugations to facilitate the folding.

FIGS. 2 and 3 illustrate the internal structure of the portable toilet seat, as well as illustrating its folding capability. The base structure of the portable seat is formed of a continuous span, i.e., a single piece, of reasonably stiff and rigid sheet material 12. This sheet of material 12 is preferably a sheet of corrugated material, as shown in FIGS. 2 and 3. The material may be an inexpensive cardboard if so desired, as it is well protected from moisture by an outer cover, described further below. Alternatively, the corrugated sheet or span of material 12 may be plastic.

The corrugated base sheet 12 has an upper surface 14 and an opposite lower surface 16. The upper surface 14 serves as an attachment surface for a flexible sheet of air-filled plastic wrap 18, e.g., Bubble Wrap®, disposed thereon. Preferably a flexible layer or sheet of non-woven fiber batting 20, e.g., polyester, etc., is provided over the air-filled plastic wrap 18, with the air-filled plastic wrap layer or sheet 18 being sandwiched between the batting layer 20 and the corrugated base sheet or layer 12. One or more alternative padded materials may be used to form the padded layer(s) atop the base sheet 12, as desired.

The various layers or sheets of material are enclosed within upper and lower covers, respectively 22 and 24, of thin, pliable, and liquid impervious plastic sheet material. The upper cover 22 is applied over the batting layer 20, and the lower cover 24 is applied directly to the lower or bottom surface 16 of the base sheet 12. The base sheet 12, air-filled plastic wrap layer 18, and batting layer 20 all have common inner peripheries 26 and opposite outer peripheries 28 (shown in FIGS. 1, 4, and 5), with these peripheries being configured such that the sheets or layers 12, 18, and 20 are at least generally congruent with a conventional toilet seat, generally as shown in FIG. 1 of the drawings. The upper and lower covers 22 and 24 are imperviously sealed, e.g., heat sealed, to one another along their common inner peripheries (essentially congruent with the inner peripheries 26 of the layers or sheets 12, 18, and 20, as shown in FIG. 1) and on a line along or outwardly displaced from the outer peripheries 28 of those layers or sheets 12, 18, and 20, thereby forming a liquid impervious enclosure about the layers or sheets 12, 18, and 20.

At least one of the plies or sheets comprising the upper and lower covers 22 and 24 preferably extends outwardly somewhat beyond the outer periphery 28 of the layers or sheets 12, 18, and 20, as shown in FIG. 1 of the drawings. The two cover sheets 22 and 24 may be sealed to one another about the outer periphery 28 of the components 12, 18, and 20, with at least one (or both) of the cover sheets 22 and/or 24 extending beyond the outer periphery 28. If both the upper and lower cover sheets 22 and 24 are extended, they may be further sealed to one another about their mutual outer edges 30 to prevent the entry of contamination therebetween. The provision of the additional outwardly extended portion 32 of the cover(s) 22 and/or 24 forms a drape that extends downwardly over the outer edge of the toilet seat and the rim of the bowl, thereby precluding direct contact with the seat and/or bowl rim if a person were to use his or her hands to assist in lowering or raising him or herself onto or from the toilet T.

While the draped cover extension 32 may provide some security in holding the portable seat 10 atop the conventional permanently attached seat of the toilet T, it is preferred that additional removable attachment means be provided. FIGS. 2 and 3 illustrate suction cups 34*a* (FIG. 2) and 34*b* (FIG. 3) extending from the base sheet 12 and through its cover 24 to secure the portable seat 10 to the underlying seat of the toilet T. Each of the suction cups 34*a*, 34*b* has a stem, respectively 36*a*, 36*b*, that passes through the lower or bottom cover sheet 24 and the lower ply or surface 16 of the base sheet 12 to secure the suction cups 34*a*, 34*b* permanently to the portable seat 10. In this manner, the resilient upper layers or sheets 18 and 20 extend over the tops of the suction cup stems 36*a*, 36*b* to provide a reasonably soft upper surface for the device 10. Preferably at least two reasonably widely separated suction cups are installed through the base sheet 12, to establish two separate points of attachment and prevent the portable seat 10 from rotating or pivoting about a single such suction cup attachment. However, more suction cups may be provided if desired, with the locations of those suction cups not being critical.

FIGS. 2 and 3 also illustrate the means of establishing a fold across the relatively rigid material of the corrugated base sheet 12. In FIG. 2 the fold 38*a* is formed parallel to the corrugations within the base sheet, with such a fold requiring little more than the creasing of the inner or upper ply or surface 14 of the base sheet 12. The soft and resilient nature of the air-filled plastic wrap 18, batting 20, and upper cover sheet 22 permit those plies or layers to be folded readily when the base sheet 12 is creased and folded as shown in FIG. 2.

In FIG. 3 the fold 38*b* is made across the corrugations of the base sheet 12. The relative rigidity of the corrugations in this orientation serves to stiffen the base sheet 12 in that direction, thus making it more difficult to fold. While such material may still be folded as desired, the base sheet 12 may be provided optionally with a score line or notch 40 across the corrugations in order to facilitate folding, as shown in FIG. 3. The soft and resilient nature of the air-filled plastic wrap 18, batting 20, and upper cover sheet 22 permit those plies or layers to be folded readily when the base sheet 12 is creased and folded along the score line 40, as shown in FIG. 3.

Figure 4:
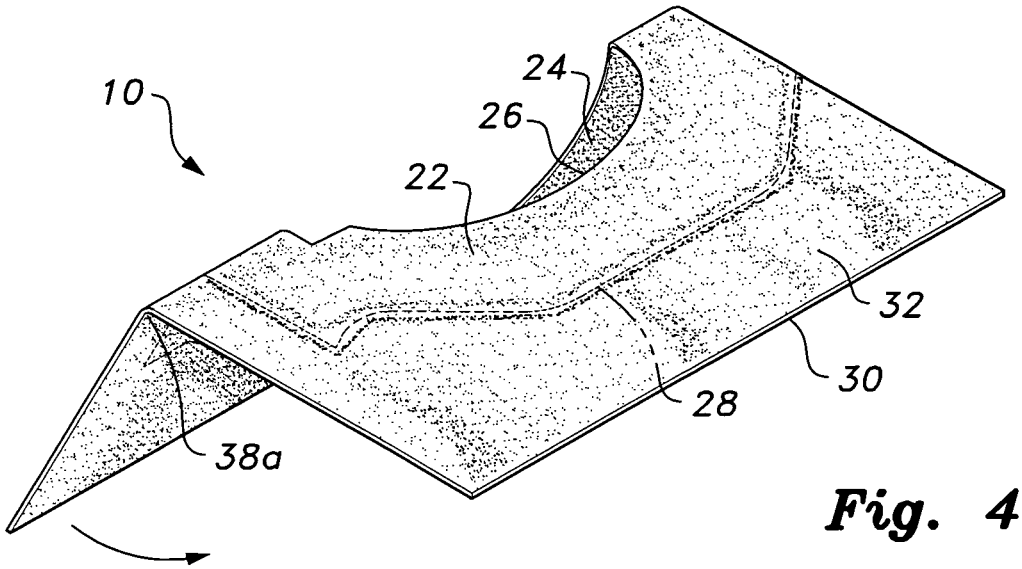
FIG. 4 is a perspective view of the portable toilet seat, showing the seat partially folded along its longitudinal fold line.
Figure 5:
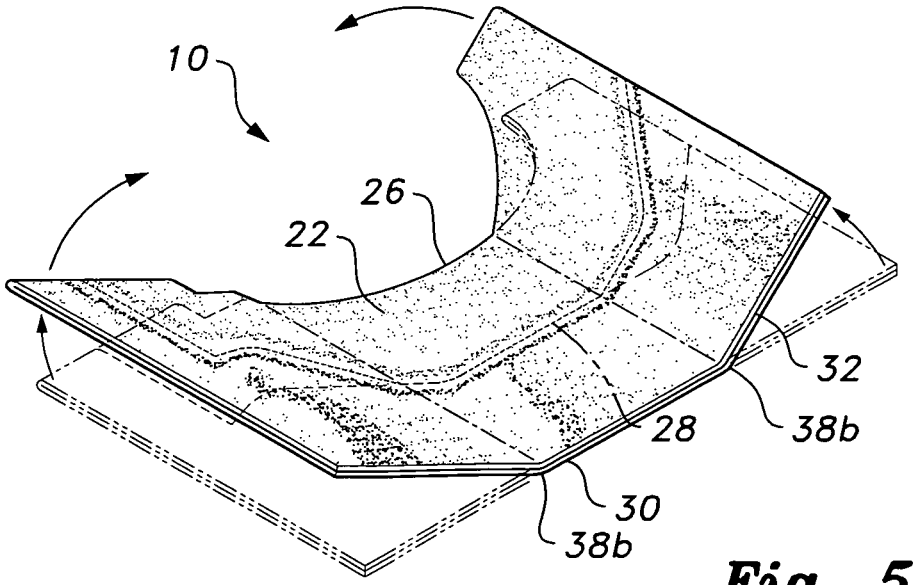
FIG. 5 is a perspective view showing the portable toilet seat completely folded along its longitudinal fold line and partially folded along its two lateral fold lines.
Figure 6:
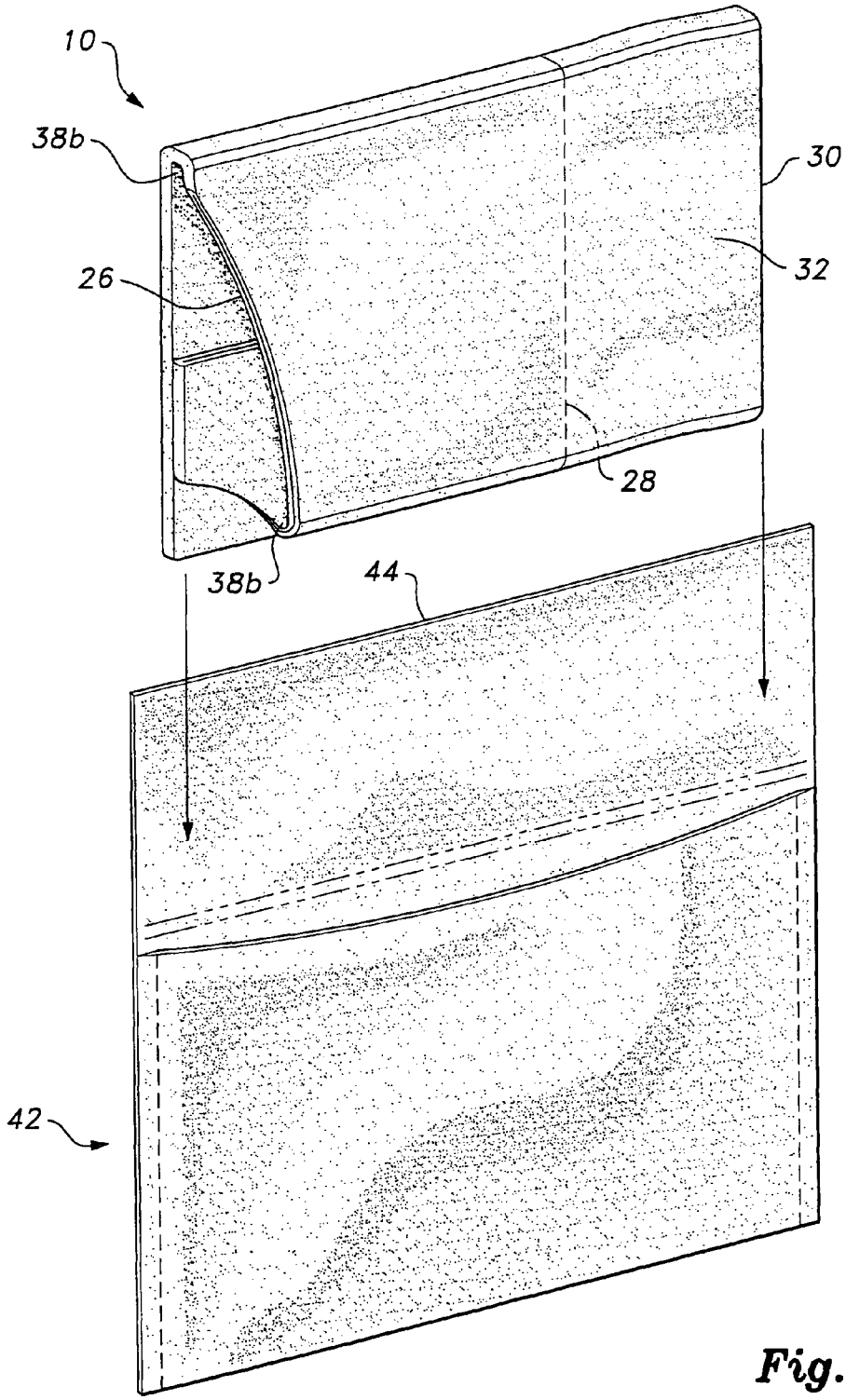
FIG. 6 is an exploded perspective view of the portable toilet seat in its completely folded state for insertion into a storage bag.

The portable toilet seat 10 is configured for folding, to provide for compact storage of the device. FIGS. 4 through 6 illustrate an exemplary folding pattern that may be used with the seat 10. In FIG. 4 a first fold 38*a* is formed longitudinally across the center of the portable seat 10, i.e., from front to rear across the device. FIG. 5 shows the portable seat 10 completely folded along the longitudinal first fold line, with lateral second and third folds 38*b* formed across the folded over lateral portions of the device. Other folding patterns may be used as desired.

In FIG. 6 the portable toilet seat 10 is shown completely folded, forming a compact device for storage. A storage bag or container 42 may be provided for the storage of the portable seat 10, as desired. In this manner, the portable toilet seat 10 may be carried unobtrusively into a public restroom or other toilet facility for use away from home. The cover flap 44 of the storage container 42 may be opened and the portable seat 10 withdrawn from the container, placed upon the public toilet T, and secured to the seat thereof by the suction cups 34*a* and 34*b*, generally as shown in FIG. 1. The weight of the person using the portable seat 10 assures that the suction cups remain compressed against the underlying toilet seat to provide solid attachment thereto for the portable seat 10. Once the user has finished using the toilet T the portable seat 10 is easily removed therefrom by releasing the suction on the suction cups, and the device may be folded and replaced in its storage container 42. The liquid impervious cover sheets 22 and 24 allow the portable seat 10 to be washed as desired or required without harm to the device, thus readying it for future reuse.

It is to be understood that the present invention is not limited to the embodiments described above, but encompasses any and all embodiments within the scope of the following claims.

We claim:

1. A portable toilet seat, comprising:

a continuous base sheet having an upper surface and a lower surface opposite the upper surface;

a first layer of cushion material disposed upon the upper surface of the base sheet;

wherein the first layer of cushion material comprises a layer of air-filled cushioning pockets being located on a substrate wherein the air-filled pockets project outwardly from the substrate;

a second layer of cushion material disposed over the first layer of cushion material, wherein the first and second layers are distinct materials, the second layer and the base sheet sandwiching the first layer therebetween, the base sheet, the first layer, and the second layer all having common inner and outer peripheries, the inner and outer peripheries being dimensioned and configured for placement on a public restroom toilet seat;

an upper cover of thin, pliable, and liquid impervious plastic material; and a lower cover of thin, pliable, and liquid impervious plastic material, the upper cover and the lower cover being sealed to one another and forming a liquid impervious enclosure surrounding the base sheet, the first layer, and the second layer.

2. The portable toilet seat according to claim 1, wherein the base sheet comprises a continuous span of folding corrugated material.

3. The portable toilet seat according to claim 2, wherein the corrugated material is a sheet material selected from the group consisting of corrugated cardboard and corrugated plastic.

4. The portable toilet seat according to claim 1, further including a drape extending outwardly from the outer peripheries of the base sheet, the first layer, and the second layer.

5. The portable toilet seat according to claim 1, further including a plurality of suction cups depending from the lower surface of the base sheet and extending outwardly through the lower cover.

6. The portable toilet seat according to claim 1, wherein a longitudinally oriented first fold and laterally oriented second and third folds are disposed across the base sheet and the padded material.

7. The portable toilet seat according to claim 1, further including a portable toilet seat storage container.

8. The portable toilet seat according to claim 1, wherein the second layer of cushion material comprises a layer of non-woven batting disposed over the air-filled pockets, the non-woven batting and the base sheet sandwiching the air-filled pockets therebetween.

* * * * *